US006484953B2

(12) United States Patent
Freier

(10) Patent No.: US 6,484,953 B2
(45) Date of Patent: Nov. 26, 2002

(54) WATER SPOUT WITH REMOVABLE LAMINAR FLOW CARTRIDGE

(75) Inventor: Donald P. Freier, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 09/777,936

(22) Filed: Feb. 6, 2001

(65) Prior Publication Data

US 2002/0104906 A1 Aug. 8, 2002

(51) Int. Cl.[7] ..... B05B 1/34
(52) U.S. Cl. ..... 239/461; 239/590
(58) Field of Search ..... 239/590–590.5, 239/461–462, 553.5

(56) References Cited

U.S. PATENT DOCUMENTS

| | | | | | |
|---|---|---|---|---|---|
| 597,842 | A | * | 1/1898 | Edmands | 239/590 |
| 2,558,238 | A | * | 6/1951 | Collins | 239/590 |
| 2,832,643 | A | * | 4/1958 | Bletcher et al. | 239/590 |
| 3,428,258 | A | | 2/1969 | Duggan | |
| 3,630,444 | A | | 12/1971 | Nelson | |
| 3,642,213 | A | * | 2/1972 | Parkison et al. | 239/553 |
| 3,730,440 | A | | 5/1973 | Parkison | |
| 3,851,825 | A | * | 12/1974 | Parkison et al. | 239/590.3 |
| 4,119,276 | A | | 10/1978 | Nelson | |
| 4,354,635 | A | | 10/1982 | Barnert et al. | |
| 4,657,186 | A | | 4/1987 | Shapiro | |
| 4,730,786 | A | | 3/1988 | Nelson | |
| 4,749,126 | A | | 6/1988 | Kessener et al. | |
| 4,795,092 | A | | 1/1989 | Fuller | |
| 4,811,905 | A | | 3/1989 | Ishikawa et al. | |
| 4,901,922 | A | | 2/1990 | Kessener et al. | |
| 5,115,973 | A | | 5/1992 | Fuller et al. | |
| 5,160,086 | A | | 11/1992 | Kuykendal et al. | |
| 5,169,065 | A | | 12/1992 | Bloch | |
| 5,213,260 | A | | 5/1993 | Tonkinson | |
| 5,222,672 | A | * | 6/1993 | Hart et al. | 239/553.5 |
| 5,242,119 | A | | 9/1993 | Jariyasunant | |
| 5,309,581 | A | | 5/1994 | Lockwood et al. | |
| 5,431,342 | A | | 7/1995 | Saripalli et al. | |
| 5,641,120 | A | | 6/1997 | Kuykendal et al. | |
| 5,779,099 | A | | 7/1998 | D'Andrade | |
| 5,819,335 | A | | 10/1998 | Hennessy | |
| 6,290,149 | B1 | * | 9/2001 | Daniel et al. | 239/504 |

* cited by examiner

*Primary Examiner*—Lesley D. Morris
(74) *Attorney, Agent, or Firm*—Quarles & Brady LLP

(57) ABSTRACT

A water spout is capable of providing laminar flowing fluid from a wall-mounted or faucet fixture body. The fixture body defines a cavity and a port for connection of a plumbing supply line. A cartridge assembly is disposed in the body cavity. The cartridge has a housing with an inlet opening and an outlet opening in fluid communication with the port. The cartridge housing contains a plurality of elements between the inlet and outlet openings for smoothing the flow of fluid passing through the cartridge assembly. A nozzle, positioned adjacent the outlet opening of the cartridge, has a sharp-edged orifice through which fluid leaving the fixture can be projected in a single laminar stream. The nozzle can be removed from the fixture body after the fixture body has been mounted for use such that all of the flow smoothing elements can be removed at once by removing the cartridge assembly from the cavity.

10 Claims, 3 Drawing Sheets

FIG. 3
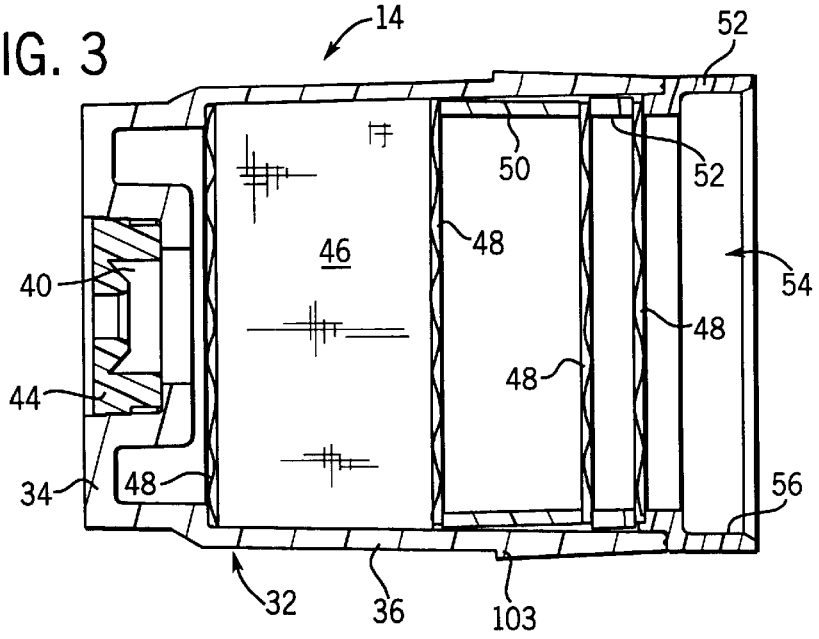
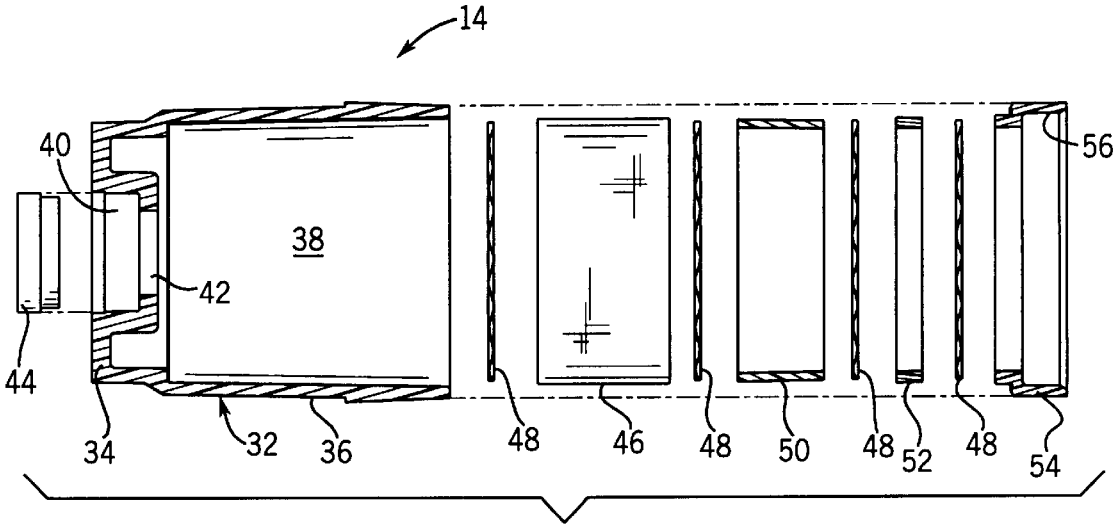
FIG. 4

FIG. 5
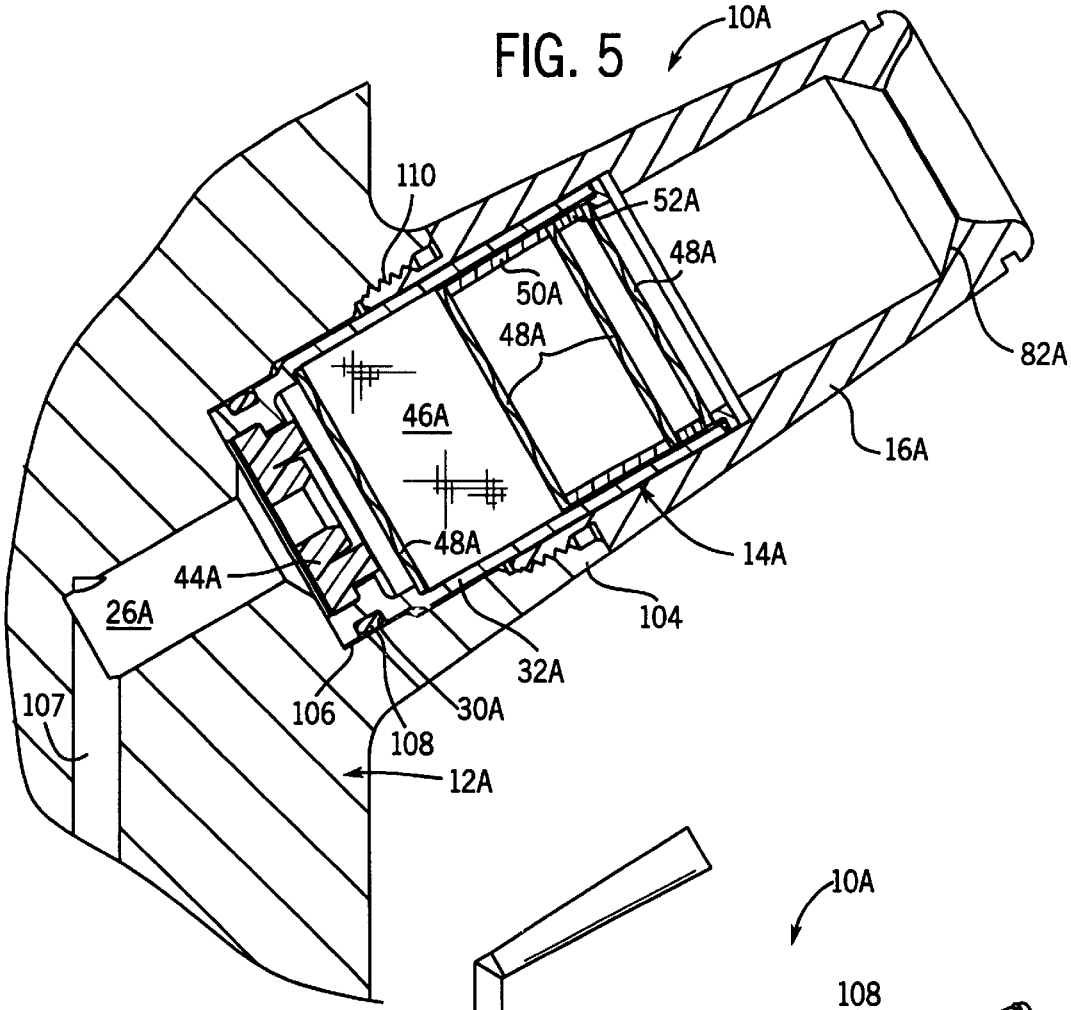
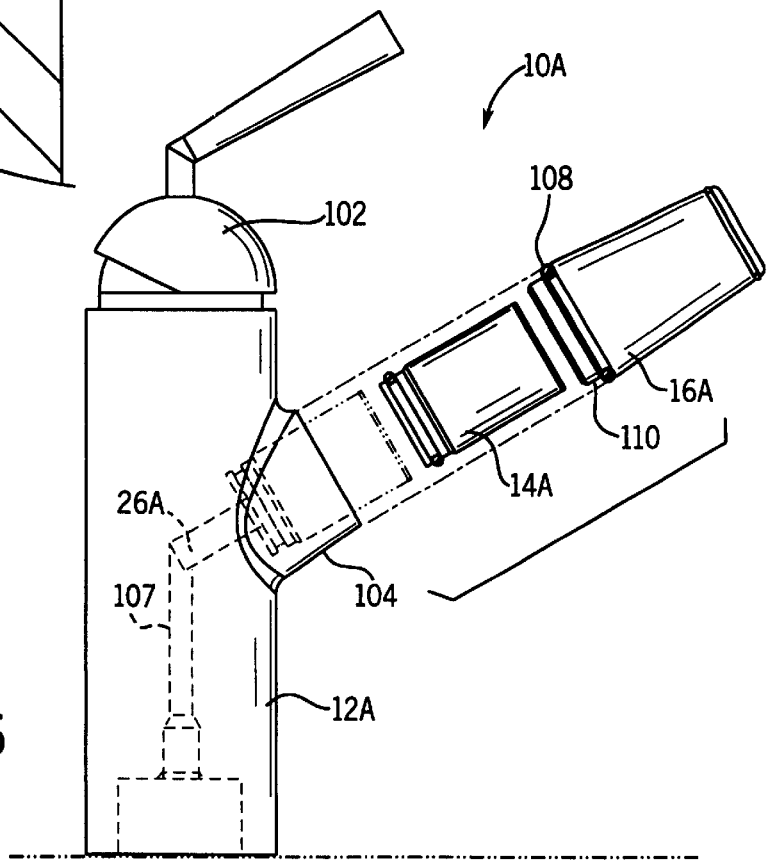
FIG. 6

WATER SPOUT WITH REMOVABLE LAMINAR FLOW CARTRIDGE

CROSS-REFERENCE TO RELATED APPLICATIONS

Not applicable.

STATEMENT REGARDING FEDERALLY SPONSORED RESEARCH/DEVELOPMENT

Not applicable.

BACKGROUND OF THE INVENTION

The present invention relates to plumbing fixtures, and more particularly to water spouts that deliver a stream of laminar fluid.

Plumbing fixtures providing laminar flowing streams of water have previously been described. See e.g. U.S. Pat Nos. 3,730,440, 3,851,825, 4,119,276, 4,657,186, 4,730,786, 4,795,092, 5,160,086, 5,213,260, and 5,242,119. Laminar flow, as used herein, means fluid flow that is generally non-turbulent having essentially non-fluctuating local velocities and pressures such that the resulting stream has a generally rod-like appearance. Such laminar flow is desired for ornamental purposes because the outgoing stream typically appears to be like a clear glass rod.

Supply water is typically fed through a series of flow smoothing elements before exiting through a suitable nozzle orifice. The flow smoothing elements are usually perforated disks, screens and filters which are arranged in series downstream from the supply water connection. The flow smoothing elements alter the flow velocity and redistribute the velocity profile as needed to convert turbulent flow into laminar flow.

One problem with existing fixtures is that small openings in the screens, filters and perforated disks can become clogged over time from build-up of mineral deposits and gravel in the supply water. This can result in reduced and/or non-laminar flow. To correct this, the clogged elements may need to be periodically removed from the fixture to be cleaned or replaced.

Typically, the flow smoothing elements are separately assembled into the fixture such that to remove them one must disassemble the relatively tiny elements piece by piece. After being cleaned or replaced, each element then must be reassembled in the original order so as to provide the proper flow characteristics. This task can be tedious, be susceptible to error, require manual dexterity, and may (in any event) be beyond the skill level of some consumers (thereby requiring professional plumbing assistance). The task is even more arduous if the flow smoothing elements are not accessible from the interior of a room without breaking a permanent wall.

Accordingly, a need exists for an improved water spout in which the flow smoothing elements can be more easily cleaned, serviced or replaced.

BRIEF SUMMARY OF THE INVENTION

In one aspect the invention provides a water spout having a fixture body defining an open-ended cavity and a port leading to the cavity that is connectible to a plumbing supply line. A cartridge is removably disposed in the body cavity and has a housing with an inlet opening in fluid communication with the port in the fixture body and an outlet opening.

The housing contains a plurality of flow smoothing elements positioned between the inlet and outlet openings for rendering the flow of fluid passing through the cartridge laminar. A nozzle is positioned adjacent the outlet opening of the cartridge and it has an orifice through which fluid leaving the spout can be projected in the form of a stream.

In preferred forms the housing is an open-ended housing and a cap is engageable adjacent the open end of the housing. The inlet opening is located in a recess of a rear wall of the housing opposite the cap, and the outlet opening is located in the cap. A pressure compensating flow regulator is disposed in the recess.

In other forms of the invention the plurality of flow smoothing elements are selected from the group consisting of screens and foam filters. Also, a screen can be disposed between a foam filter and a ring spacer in the cartridge.

In still other variants, the fixture body can be a cup-shaped member with one closed end and an opposite open end having a circumferential flange for assisting in clamping a wall if the spout is mounted through the wall. The port is disposed in a radial wall, and a flanged clamping sleeve telescopes into the body radially outside of the cartridge. This latter feature allows the assembly to be easily adjusted for walls of different thickness.

In yet another variant, the fixture body is a faucet body having a projecting stem that in part defines the cavity. The nozzle is engaged to the stem.

Another aspect of the invention is the provision of replacement cartridges containing the flow smoothing elements. Such replacement cartridges can be used in such lavatory faucet bodies, or in housings attachable to a vertical room wall.

The present invention thus provides a plumbing fixture that can deliver a laminar stream of water. A compact, easily replaceable cartridge contains all of the flow smoothing and pressure regulating elements that are needed, so that they can all be removed from the fixture at once (for cleaning, service or replacement). Moreover, the housings of the present invention are designed to provide easy access to the cartridge without requiring access to the backside of a room wall.

The foregoing and still other advantages of the invention will appear from the following description. In that description reference is made to the accompanying drawings which form a part hereof and in which there is shown by way of illustration preferred embodiments of the invention. These embodiments do not represent the full scope of the invention. Thus, the claims should be looked to in order to judge the full scope of the invention.

BRIEF DESCRIPTION OF THE DRAWINGS

FIG. 3 is a vertical cross-sectional view taken along line 3—3 of FIG. 2;

FIG. 4 is an exploded view, partially in section, of the FIG. 3 cartridge;

FIG. 5 is a vertical cross-sectional side view of an alternative embodiment, that of a faucet spout mountable in a horizontal surface; and FIG. 6 is an exploded side view of the faucet of FIG. 5.

DESCRIPTION OF THE PREFERRED EMBODIMENTS

Figure 1:
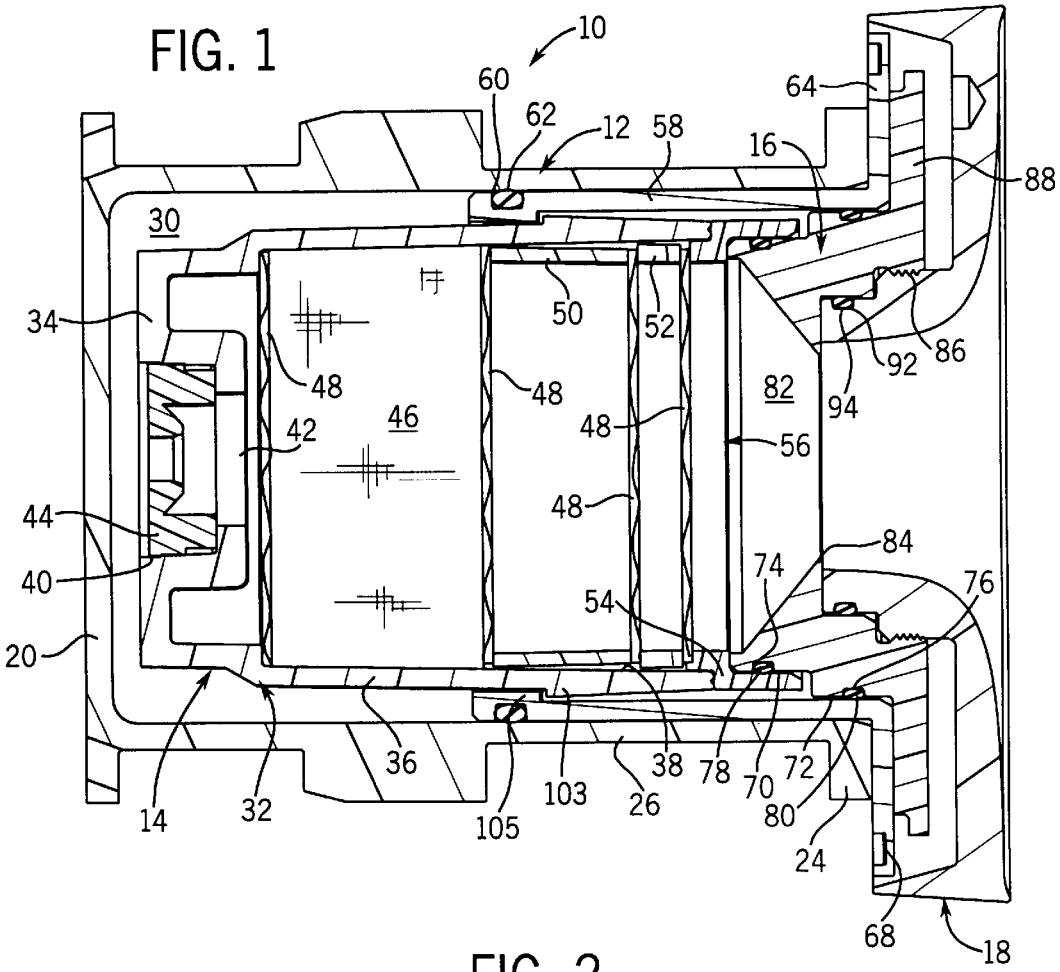
FIG. 1 is a vertical cross-sectional view of a wall-mounted spout of the present invention.
Figure 2:
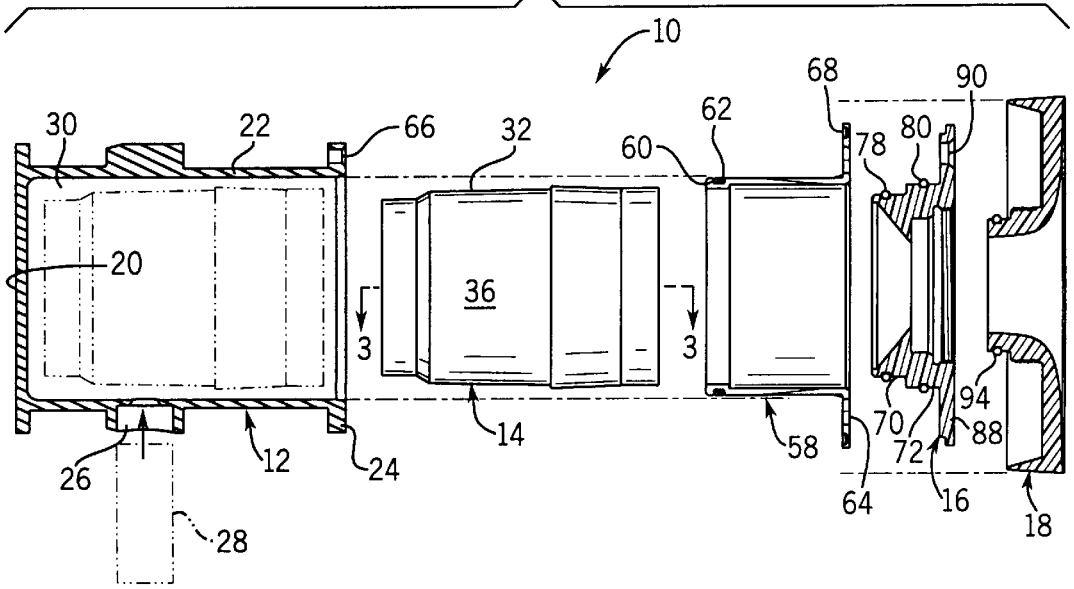
FIG. 2 is an exploded view thereof, albeit with the rear fixture body rotated 90° and the cartridge shown in full.

Referring first to FIGS. 1 and 2, a wall mountable plumbing fixture 10 includes as its major components, a rear fixture body 12, a laminar flow cartridge 14, a frontal nozzle 16 and a decorative escutcheon 18. The fixture body 12 has a generally cylindrical cup shape, and it is preferably made of brass. It includes a rear base 20, a tubular wall 22 and a frontal end flange 24. The tubular wall 22 has a radial port 26 at which a water supply line 28 can be connected. The fixture body 12 has a cavity 30 for housing the cartridge 14.

Referring next to FIG. 3, cartridge 14 has a generally cylindrical outer housing 32 having a base 34 and a cylindrical wall 36 enclosing chamber 38. The base 34 has a circular rearwardly open recess 40 with a small, central inlet opening 42. A disk-shaped pressure compensating flow regulator 44, such as one commercially available from Neoperl, Inc. of Waterbury, Conn., is pressed into the recess 40.

As water pressure increases, the regulator is of the type that flexes to reduce the volume of the central inlet. This keeps the volume of flow through the regulator relatively constant. Preferably, the flow regulator 44 has an operable pressure range of 12–145 psi (0.8–10 bar).

Housing 32 is preferably made of a plastic, such as NORYL® (a trademark of General Electric) which is a blend of polyphenylene sulfide and polystyrene resins. Housing 32 can have an inner diameter of approximately 2 inches with the outer diameter of the flow smoothing elements being slightly smaller. The outer diameter of the housing 32 can then be a little over 2 inches with an overall length of just over three inches.

The housing chamber 38 contains a series of circular or cylindrical flow smoothing members. In particular, the flow smoothing members include a filter 46, four screens 48 and two ring spacers 50 and 52. The filter 46 is preferably made of a reticulated polyurethane foam disk having a pore size of approximately 45 pores per inch. See also U.S. Pat. No. 4,795,092 for a discussion of open cell foam filters.

The screens 48 are preferably made of 20×20 stainless steel mesh. The ring spacers 50 and 52 are preferably Noryl® and preferably 0.65 and 0.20 inches in length, respectively. The flow smoothing members can be arranged in series in the chamber 38 in the order shown in FIGS. 3 and 4, that is with one screen 48 on each side of the filter 46, followed by ring spacer 50, the third screen 48, disk 52 and then the forth screen 48. These elements are held together by a Noryl® cap 54 fit onto the open end of the housing 32 by a suitable means, such as threads or ultrasonic weld. The cap 54 is essentially a ring with a stepped cross-section defining two different inner diameters with the smaller being in the end of the housing 32. The cap 54 has a large, full-width outlet opening 56.

Referring again to FIGS. 1 and 2, a cylindrical brass sleeve 58 having an outer diameter slightly less than the inner diameter of the fixture body 12, telescopically fits in the fixture body cavity 30 around one end of the cartridge 14. At an inner end of the sleeve 58 there is a circumferential groove 60 containing an o-ring 62 creating a water-tight circumferential seal between the sleeve 58 and the fixture body 12. This seal can be maintained while the sleeve 58 is slid axially with respect to the fixture body 12.

The other end of the sleeve 58 has a circular flange 64 for abutting the exposed surface of a wall when recess mounting the fixture 10 in a wall opening. Sleeve 58 can be slid axially relative to body 12 to permit room walls of varied sizes to be sandwiched between this flange 64 and the end flange 24 of the fixture body 12. Threaded fasteners (not shown) are threaded into openings 66 and 68 in the respective flanges 88, 24 and 64 to clamp a room wall. The fasteners can be tightened or loosened as needed to secure the fixture 10 to varying thicknesses of the room wall.

For example, one can make a rough-in installation, followed by a refined tightening when the final wall board is installed. Later adjustment to accommodate the finished wall is accomplished by axial sliding of sleeve 58.

The nozzle 16 is preferably a brass annular body having a stepped outer wall defining two outer diameters 70 and 72, with circumferential grooves 74 and 76 containing o-rings 78 and 80, respectively. Outer diameter 70 is sized to fit within the outlet opening 56 with o-ring 78 providing a water-tight seal. Outer diameter 72 is sized so that o-ring 80 mates with the inner diameter of the sleeve 58 to provide a water tight seal.

Orifice 82, in the shape of a frustoconical recess tapering away from the cartridge 14, is provided, leading to a sharp edge 84. The other end of the nozzle 16 includes a coaxial stepped inner diameter with a larger diameter having internal threads 86. This end of the nozzle 16 also includes a flange 88 having threaded openings 90 alignable with the openings 68 in the sleeve flange 64 for securing the nozzle 16 in place.

Escutcheon 18 is preferably a decorative, polished brass annular flange member having a front end with an outer diameter greater than the sleeve 58 and nozzle 15. An inner end of the escutcheon 18 has an outer diameter with a circumferential groove 92 containing an o-ring 94 and sized so that the o-ring provides a water-tight seal against the smaller inner diameter of the nozzle 16 and a larger, threaded outer diameter section 100 that threads into the nozzle 16. The inner diameter at the inner end of the escutcheon 18 is slightly larger than the orifice edge 84 and it tapers smoothly outward to meet the outer diameter at the front end.

When the water supply line 28 is connected the fixture 10, water can flow into the fixture body cavity 30 radially, pass back and then radially inward to the flow regulator 44, and then into the cartridge 14 through the inlet opening 42.

As described above, flow regulator 44 works in response to fluctuations in flow rate to adjust the passable size of the inlet opening 42 so as to provide a relatively constant flow rate into the cartridge 14. The flow smoothing elements (filter, screens) as well as the spacers are selected and arranged to more evenly distribute the velocity profile of the water passing through the inlet opening 42 throughout the entire inner diameter of the cartridge housing 32 and essentially eliminate turbulence and air pockets.

Specifically, water flowing through the inlet opening 42 enters the chamber 38, which has a significantly larger diameter. This sudden expansion in cross-section is intended to reduce the flow velocity of the water. As the water passes through the pores of the filter 46 the non-axial velocity vectors (causing turbulence) are blocked by the foam material so that the water leaves the filter 46 with the velocity vectors directed axially. As the water passes through the series of screens 48 the velocity profile is flattened so that there is a nearly uniform flow from the middle to the edges of the flow cross-section. The spacers 50 and 52 separate the screens 48 so that they operate in stages, allowing the water to recover before entering the next screen 48.

The water exits the cartridge 14 through the nozzle 82. The sharp edge 84 provides sufficient separation to form a single stream of water in laminar flow with little or no side spray. The emanating stream is clear and smooth, and interestingly resembles a glass rod.

For routine maintenance (e.g. in the event the flow state of the stream changes over time due to deposits of calcium or other minerals in the water, or the presence of gravel) all flow smoothing elements can be quickly and easily removed from the fixture body 12 at once for cleaning or replacement by removing the cartridge 14. This can also be achieved without access to the rear of the wall.

The escutcheon 18 is unscrewed from the nozzle 14 and the threaded fasteners in the flanges 88, 64 and 24 are removed so that the cartridge 14 can be removed from the chamber 38 after pulling out nozzle 16 and sleeve 58. The flow smoothing elements and the flow regulator can be cleaned with a suitable solution, or the cartridge 14 can simply be replaced with a new one. In either case, the sleeve 58 can be inserted into the chamber 38 until flange 64 contacts the exposed wall surface. Then, the cleaned or new cartridge 14 can be inserted into the sleeve 58 until the respective circumferential catch surfaces 103 and 105 engage, and the nozzle 16 can then be inserted into the sleeve 58 until the orifice 82 seats in the outlet opening 56. The threaded fasteners, and then the escutcheon 18, are re-fastened.

FIGS. 5 and 6 illustrate an alternate faucet embodiment. In this embodiment, like elements are referred to in the drawings with similar reference numbers, although with the suffix "A". The plumbing fixture 10A includes a brass faucet body 12A supporting a conventional flow control valve 102. After water is mixed and/or volume controlled by this valve, it passes down then into passage 107.

The faucet body 12A also includes a spout stem 104 defining a receiving cavity 30A for containing laminar flow cartridge assembly 14A. The base of the cavity 30A has a port 26A to which is coupled conduit 107.

The cartridge 14A smooths the flow of water passing there through as discussed above and includes the same components made of the same materials as discussed above, albeit preferably in a slightly smaller scale. In one preferred form, the cartridge housing 32A has an outer diameter of approximately 0.9 inches and an overall length of just under 1.5 inches. The flow smoothing elements (filter 46A, screens 48A and spacers 50A and 52A) and a flow regulator 44A are proportionately smaller. Additionally, unlike the cartridge described above, the housing 32A includes a circumferential groove 106 along its outer diameter for containing an o-ring 108 which mates with the inner walls of the cavity 30A near its base.

The spout stem 104 also includes internal threads 108 at the open end of the cavity 30A. The threads 108 are engaged by a threaded end 110 of a nozzle 16A. The nozzle 16A is an inverted cup-shaped member having a tapered sharp-edged orifice 82A at one end. The spout stem 104, as shown in FIGS. 5 and 6, is angled upwardly such that the emanating stream will form an arcuate path. Entry water enters axially here, but the operation of the cartridge is otherwise similar.

Thus, the present invention provides spouts suitable for creating a laminar stream of water in a variety of plumbing environments. A compact cartridge contains all of the flow smoothing and pressure regulating elements so that they can all be removed from the fixture in one unit, for cleaning, service or replacement. The cartridge can be easily removed from an end of the fixture in the interior of the room by loosening and removing the nozzle (and where applicable escutcheon).

While specific embodiments have been shown, various modifications falling within the breadth and scope of the invention will be apparent to one skilled in the art. Thus, the following claims should be looked to in order to understand the full scope of the invention.

Industrial Applicability

Disclosed are water spouts that provide laminar flow and have unitary replaceable cartridges.

I claim:

1. A water spout, comprising:

a fixture body defining an open-ended cavity and a port leading to the cavity that is connectible to a plumbing supply line;

a cartridge removably disposed in the body cavity and having a housing with an inlet opening and an outlet opening, the inlet opening being in fluid communication with the port in the fixture body, the housing containing a plurality of elements positioned between the inlet and outlet openings for rendering the flow of fluid passing through the cartridge laminar;

a nozzle positioned adjacent the outlet opening of the housing having an orifice through which fluid leaving the spout can be projected in a stream; and a flanged sleeve that telescopes into the body radially outside of the cartridge.

2. The spout of claim 1, wherein the housing includes a ring-shaped cap at the outlet.

3. The spout of claim 2, wherein the inlet opening is located in a recess of a rear wall of the housing opposite the cap, and wherein the outlet opening is located in the cap.

4. The spout of claim 3, further including a pressure compensating flow regulator disposed in the recess.

5. The spout of claim 1, wherein the plurality of elements include at least one screen and a foam filter.

6. The spout of claim 5, wherein a screen is disposed between a foam filter and a ring spacer in the cartridge.

7. The spout of claim 1, wherein the fixture body is a cup-shaped member with one closed end and an opposite open end having a circumferential flange for assisting in clamping a wall when the spout is mounted through the wall.

8. The spout of claim 7, wherein the port is disposed in a radial wall.

9. A water spout, comprising:

a fixture body defining an open-ended cavity and a port leading to the cavity that is connectible to a plumbing supply line;

a cartridge removably disposed in the body cavity and having a housing with an inlet opening and an outlet opening, the inlet opening being in fluid communication with the port in the fixture body, the housing containing a plurality of elements positioned between the inlet and outlet openings for rendering the flow of fluid passing through the cartridge laminar; and a nozzle positioned adjacent the outlet opening of the housing having an orifice through which fluid leaving the spout can be projected in a stream, the nozzle tapering in a downstream direction.

10. The spout of claim 9, wherein the fixture body is a faucet having a projecting stem in part defining the cavity and wherein the nozzle is engaged to the stem.

* * * * *